United States Patent [19]

Brown et al.

[11] Patent Number: 5,031,318

[45] Date of Patent: Jul. 16, 1991

[54] SAFETY RAZOR

[75] Inventors: Robert L. Brown, Boston; John D. Galligan, Weston, both of Mass.

[73] Assignee: The Gillette Company, Boston, Mass.

[21] Appl. No.: 497,239

[22] Filed: Mar. 22, 1990

[51] Int. Cl.[5] ..... B26B 21/00; B26B 19/28; B26B 19/18

[52] U.S. Cl. ..... 30/49; 30/42; 30/45

[58] Field of Search ..... 30/42, 43.2, 43.3, 43.7, 30/44, 45, 50, 52, 210, 32, 43.4, 49.5

[56] References Cited

U.S. PATENT DOCUMENTS

| | | | |
|---|---|---|---|
| 3,509,626 | 5/1970 | Mead | 30/45 |
| 3,793,723 | 2/1974 | Kuris et al. | 30/45 |
| 4,180,906 | 1/1980 | May | 30/42 |
| 4,301,593 | 11/1981 | May | 30/42 |
| 4,744,144 | 5/1988 | Lower, Sr. et al. | 30/45 |
| 4,807,360 | 2/1989 | Cerier et al. | 30/49 |

*Primary Examiner*—Douglas D. Watts
*Assistant Examiner*—Paeu M. Heyrana, Sr.
*Attorney, Agent, or Firm*—Fish & Richardson

[57] ABSTRACT

A hand-held razor of the wet-shave type includes a thin flexible foil member with a plurality of apertures, each of which has opposed sharpened shaving edge portions. A displacing mechanism cyclically displaces the foil along a predetermined path such that the velocity of the opposed edge portions caused by the mechanism is substantially greater than the speed of motion caused by normal shaving stroke manipulation. The amplitude of each displacement cycle is greater than the width of a beard hair and less than the distance between the opposed edge portions.

17 Claims, 2 Drawing Sheets

SAFETY RAZOR

This invention relates to safety razors, and more particularly to a razor that employs foil structure in which an array of apertures are formed, a peripheral portion of each aperture being sharpened to provide a cutting edge.

In accordance with the invention, there is provided a hand held razor of the wet-shave type that includes a handle, a head portion, foil structure with a plurality of apertures on the head portion, each aperture having opposed sharpened shaving edge portions, and a displacing mechanism coupled to the head portion for cyclically displacing the foil along a predetermined path relative to the handle portion; the velocity of the opposed edge portions caused by the displacing mechanism being substantially greater than the speed of motion caused by manual minipulation of the razor in a normal shaving stroke, and the amplitude of each displacement cycle being greater than the width of a beard hair and less than the distance between the opposed edge portions.

Preferably, the head portion has a through aperture and support surface structure bounding the through aperture, the foil structure is a thin flexible metal member of about 0.1 millimeter thickness that is disposed on the support surface structure of the body member in obstructing relation to the through aperture, the foil has at least twenty apertures, the distance between the opposed edge portions (e.g., diameter, etc.) of each aperture is less than about four millimeters, the displacement mechanism includes an electric motor, the frequency of the displacement motion along the path is between one hundred and three hundred hertz, the displacement cycle amplitude is at least about 0.1 millimeter, and the displacement cycle amplitude is up to about one quarter the distance between the opposed edge portions. The displacement mechanism may be of any suitable type, for example, of a direct-drive type or of an uncoupled offset weight type.

In a particular embodiment, the apertures are of circular configuration and of substantially the same diameter and less than about two millimeters in diameter; and the predetermined path is of circular configuration and of diameter about one quarter of the diameters of the apertures. In another particular embodiment, the apertures are of slot configuration and have parallel opposed sharpened shaving edge positions that are spaced less than four millimeters apart, the predetermined path is along a straight line perpendicular to the parallel shaving edge portions (although in other embodiments it may be at an angle to the shaving edge portions), and the displacement mechanism reciprocates the foil along the straight line with an amplitude of travel of the foil of about one fourth the space between the opposed edge portions.

Other features and advantages will be seen as the following description of particular embodiments progresses, in conjunction with the drawings, in which.

DESCRIPTION OF PARTICULAR EMBODIMENTS

Figure 1:
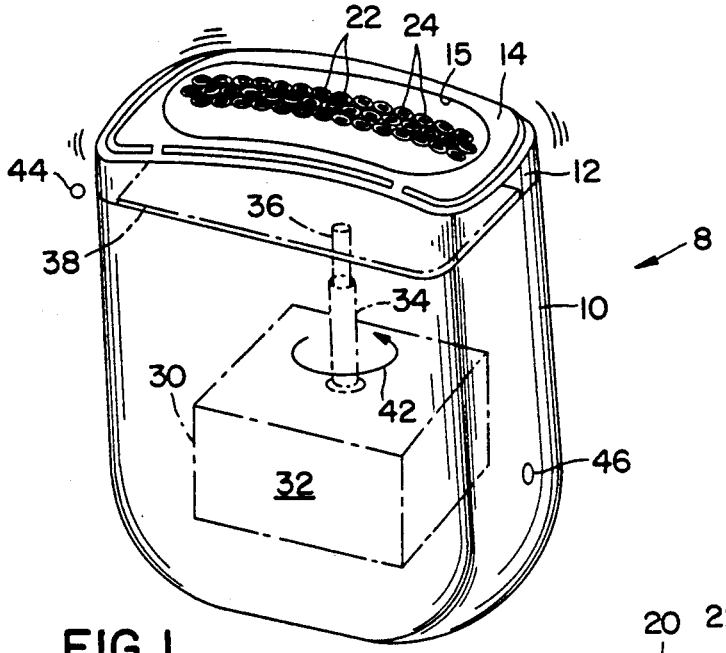
FIG. 1 is a perspective view of a razor in accordance with the invention.

The razor 8 shown in FIG. 1 includes molded body 10 and head portion 12 with top surface 14. Supported on surface 14 and positioned under aperture 15 therein is a metal foil multi-apertured blade strip 20 that has apertures 22 with edges 24 that are sharpened to provide shaving edges. Typically, foil strip 20 is manufactured from steel, has a length of about 4.2 centimeters, a width of about 2.2 centimeters and a thickness of about 0.1 millimeter. The circular apertures 22 are about one millimeter in diameter and are spaced about two millimeters on center and are disposed in rows that are spaced about one millimeter on center. Body 10 and cap portion 12 are formed of polypropylene. The cap portion 12 has a convex upper surface 14 (of about 12.5 centimeters radius). The foil is secured in recessed relation below upper skin engaging surface 14.

Razor 8 includes within body portion 10 a displacement assembly 30 that includes an electric motor 32 with shaft 34 and eccentric extension 36. Extension 36 is connected in drive relationship with support plate 38 that is rigidly connected to head portion 12. Motor 32 rotates shaft 34 and extension 36 in the direction of the arrow 42, in turn displacing head portion 12 and foil 20 in a circular path indicated schematically by arrows 44 in FIGS. 1–3. The motor may be a battery powered electric motor and handle 10 has a recharging port 46.

In operation, the user grasps the handle portion 10 of the razor, turns on motor 32, and places the foil 20 against the skin region to be shaved. Motor 32 moves the foil in oscillatory motion with a velocity that is substantially greater than the speed imposed by normal shaving stroke hand movement so that as the razor is normally passed over the skin, there is provided a cutting action that is substantially independent of the motion caused by the hand movement. Beard or other hairs are cut from more than one direction as the foil oscillates.

Figure 2A:
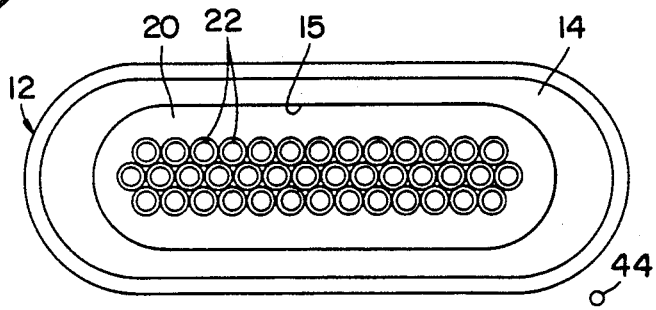
FIGS. 2A–2C illustrate the motion of the foil for the razor of FIG. 1.
Figure 2B:
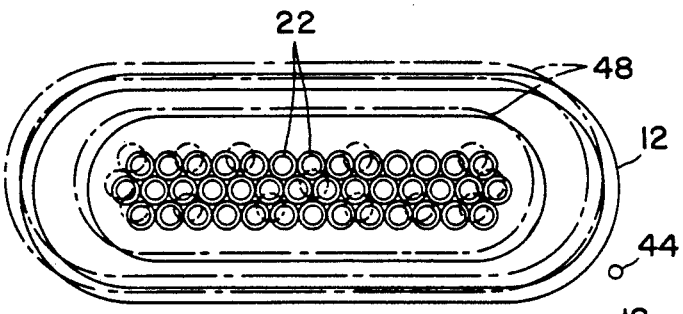
Figure 2C:
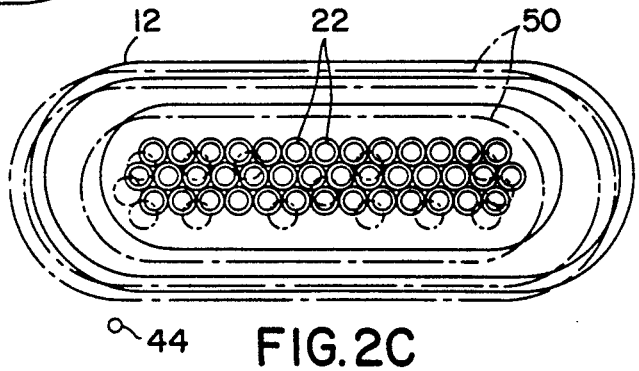
Figure 3:
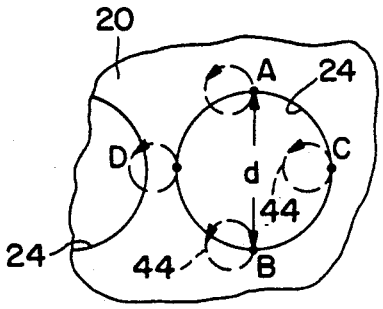
FIG. 3 is a diagrammatic view of a portion of the foil and illustrates the motion of each aperture in the foil of the razor of FIG. 1.

Referring to the diagrams of FIGS. 2A–2C and 3, foil 20 is displaced along predetermined circular or orbital path 44. From a starting position in FIG. 2, the foil is displaced along path 44 to position 48 (FIG. 2B) and to position 50 (FIG. 2C) before returning to the starting position (FIG. 2A). All the apertures 22 are simultaneously displaced in a circular path 44. Illustrated in dotted line in FIG., 3 is the simultaneous motion of opposed points A, B, C and D of the sharpened edge 24 of a single aperture 22. The circular motion 44 of the circular apertures 22 maximizes the use of the sharpened edges and enhances the shaving effect in a shaving stroke. The diameter of circular path 44 is about 0.25 millimeter, a diameter less than the diameter of the aperture but greater than the thickness of a beard hair, (typically, about 0.1 millimeter). The frequency of the circular motion is around 200 Hz.

Figure 4:
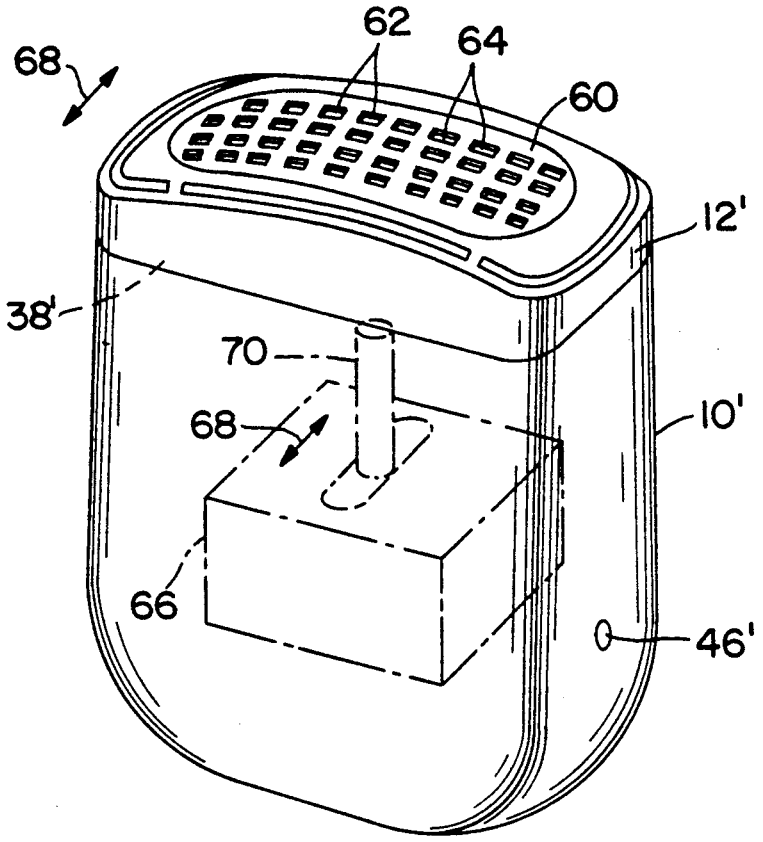
FIG. 4 is a perspective view of another razor embodiment of the invention.
Figure 5:
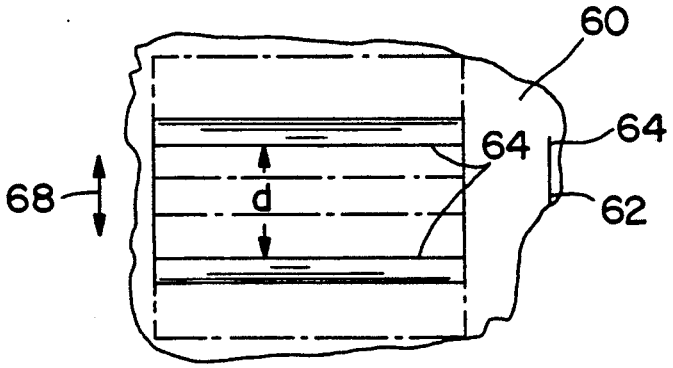
FIG. 5 is a diagrammatic view of a portion of the foil and illustrates the motion of each aperture in the foil of the razor of FIG. 4.

Referring now to FIGS. 4 and 5, razor 8' has foil 60 with slot shaped rectangular apertures 62. The opposed parallel longitudinal edges 64 are sharpened to provide shaving edges (FIG. 5). The razor includes motor 66 with coupling shaft 70 that translates head portion 12', causing the foil 60 to move in a straight line path in the direction of arrow 68, i.e., foil 60 is reciprocated in a direction perpendicular to the cutting edges 64 of apertures 62.

Each slot aperture 62 has a length of about two millimeters and is about 0.75 millimeter wide. The oscillation amplitude of foil 60 is about 0.2 millimeter, and the reciprocation frequency is about two hundred Hertz.

While particular embodiments of the invention have been shown and described, various modifications will be apparent to those skilled in the art, and therefore it is not intended that the invention be limited to the disclosed embodiments or to details thereof, and departures may be made therefrom within the spirit and scope of the invention.

What is claimed is:

1. A hand-held razor that may be moved across the skin surface by hand motion comprising a handle portion, a head portion, foil structure with a plurality of apertures on said head portion, each said aperture having opposed sharpened shaving edge portions, and a displacing mechanism coupled to said head portion for cyclically displacing said foil structure along a predetermined path relative to said handle portion; the displacement motion of said foil structure along said path having an amplitude greater than about 0.1 millimeter and less than the distance between said opposed edge portions.

2. The razor of claim 1 wherein the frequency of said displacement motion along said path is between one hundred and three hundred hertz.

3. The razor of claim 1 wherein the displacement amplitude along said path is up to about one quarter the distance between said opposed edge portions.

4. The razor of claim 1 wherein the distance between said opposed edge portions of each said aperture is less than four millimeters.

5. The razor of claim 4 wherein said apertures of said foil structure are of circular configuration and have annular sharpened shaving edge portions.

6. The razor of claim 5 wherein said predetermined path is of circular configuration, and the diameter of said path is less than the diameters of said apertures.

7. The razor of claim 4 wherein said apertures are of slot configuration and have parallel opposed sharpened shaving edge portions.

8. The razor of claim 7 wherein said predetermined path is along a straight line and said displacement mechanism reciprocates said foil structure along said straight line.

9. The razor of claim 8 wherein the amplitude of travel of said foil structure along said path is up to about one fourth the space between said opposed edge portions.

10. The razor of claim 7 wherein said opposed edge portions of each said slot are spaced less than four millimeters apart.

11. A hand-held razor that may be moved across the skin surface by hand motion comprising a handle portion, a head portion, foil structure with a plurality of apertures of slot configuration on said head portion, each said aperture having parallel opposed sharpened shaving edge portions and a length of at least about one millimeter, and a displacing mechanism coupled to said head portion for cyclically reciprocating said foil structure along a predetermined straight line path relative to said handle portion; the reciprocating motion along said path having an amplitude greater than about 0.1 millimeter and less than the distance between said opposed edge portions.

12. A hand-held razor that may be moved across the skin surface by hand motion comprising a handle portion, a head portion, foil structure with a plurality of apertures on said head portion, each said aperture being of circular configuration and having an annular sharpened shaving edge, said apertures being of substantially the same diameter, and a displacing mechanism coupled to said head portion for cyclically displacing said foil structure along a predetermined path of circular configuration relative to said handle portion; the displacement motion along said path having an amplitude greater than about 0.1 millimeter and the diameter of said path being up to about one quarter of said diameters of said apertures.

13. The razor of claim 12 wherein said apertures are less than about two millimeters in diameter.

14. The razor of claim 13 wherein said diameter of said path is about 0.25 millimeter.

15. A hand-held razor that may be moved across the skin surface by hand motion comprising a handle portion, a head portion, said head portion having a through aperture and support surface structure bounding said through aperture, foil structure with at least twenty apertures on said head portion, each said aperture having opposed sharpened shaving edge portions, said foil structure being a thin flexible metal member of about 0.1 millimeter thickness that is disposed on said support surface structure of said body member in obstructing relation to said through aperture, and a displacing mechanism coupled to said head portion for cyclically displacing said foil structure along a predetermined path relative to said handle portion, said displacing mechanism including an electric motor and a direct drive coupled to said electric motor, the displacement motion along said path having a frequency between one hundred and three hundred Hertz and an amplitude greater than about 0.1 millimeter and less than the distance between said opposed edge portions.

16. The razor of claim 15 wherein each said aperture is of circular configuration and less than two millimeters in diameter, and said predetermined path is of circular configuration, the diameter of said path being less than the diameters of said apertures.

17. The razor of claim 15 wherein each said aperture is of slot configuration and has parallel opposed sharpened shaving edge positions, said opposed edge portions of each said slot being spaced less than four millimeters apart, and the amplitude of travel of said foil along said path is about one fourth the distance between said opposed edge portions.

* * * * *